US006082925A

United States Patent [19]

Raasch

[11] Patent Number: 6,082,925

[45] Date of Patent: Jul. 4, 2000

[54] STORM SEWER OVERFLOW CONTROL DEVICE

[76] Inventor: Jason J. Raasch, 2111 N. Burke Dr., Arlington Heights, Ill. 60004

[21] Appl. No.: 09/342,109

[22] Filed: Jun. 29, 1999

[51] Int. Cl.[7] ..... E01C 11/22

[52] U.S. Cl. ..... 404/2; 404/4; 285/323; 403/371; 405/40

[58] Field of Search ..... 404/2, 4; 220/237; 285/323; 403/371; 405/40

[56] References Cited

U.S. PATENT DOCUMENTS

| | | | |
|---|---|---|---|
| 601,794 | 4/1898 | Hershberger . | |
| 712,194 | 10/1902 | Kelly . | |
| 1,347,880 | 7/1920 | Whittaker . | |
| 1,525,136 | 2/1925 | Kopke . | |
| 1,713,775 | 5/1929 | Moody . | |
| 1,905,919 | 4/1933 | Levis . | |
| 3,613,936 | 10/1971 | Kaiser et al. | 220/237 |
| 3,815,748 | 6/1974 | Johannessen . | |
| 4,712,811 | 12/1987 | Wier | 285/113 |

*Primary Examiner*—James A. Lisehora
*Attorney, Agent, or Firm*—Greer, Burns & Crain, Ltd.

[57] ABSTRACT

A storm sewer overflow control device for controlling runoff surge flows from a generally vertically oriented storm drain into a generally horizontally oriented storm sewer pipe includes an engagement portion configured for insertion into the storm sewer pipe, a flow control portion attachable to the engagement portion and configured for receiving runoff surge flow flowing down the storm drain and slowing the flow for entry into the storm sewer through the engagement portion. The engagement portion is radially expandable to sealingly engage an interior surface of the storm sewer pipe, and preferably is configured to expand radially as it is shortened axially.

20 Claims, 3 Drawing Sheets

STORM SEWER OVERFLOW CONTROL DEVICE

BACKGROUND OF THE INVENTION

The present invention relates generally to flood control devices for controlling storm-generated runoff water, and specifically to a storm sewer overflow device for controlling storm or flood generated surges of runoff flow into storm sewers.

Conventional municipal flood control systems include storm sewer mains placed parallel to the roads, with individual residential, multi-family or commercial branch lines feeding into the mains. The branch lines and mains are generally horizontally oriented in the ground, and are pitched or inclined a specified amount to facilitate water flow from one location to another. Storm drains are periodically placed along the sides of the roads, and the roads are graded to direct water into these drains. The drains are generally vertically oriented, and are in fluid communication with the mains, and possibly also with branch lines.

During or after heavy rains and/or rapid snow melt, substantial amounts of water are directed into the drains and ultimately into the mains. In some cases, the incoming water volume is greater than the capacity of the mains, and the water, seeking the point of least resistance, may flow back into the branch lines. This back flow is a major cause of residential flooding. In localities where the sewage sewers and the drain sewers are combined, the backflow may create potentially hazardous health consequences for the flooded residences.

Accordingly, efforts have been made to slow the flow of incoming water to the drains to a rate which can be accommodated by the mains without causing backflow. One such device operates on a vortex principle, when placed in the storm drain. A typical vortex device is made of stainless steel and includes a horizontal portion configured for engaging the main, and a flow control portion configured for receiving the incoming flow and restricting the amount of water which enters the main through the horizontal portion.

Conventional vortex devices are provided in various sizes to match main pipe diameters known in the industry. Installation is effected by forcing the horizontal portion into the end of the main which communicates with the storm drain, and employing a hydraulic ram to force a sealing friction fit between the horizontal portion and the inside surface of the main.

This procedure is acceptable in areas where the pipes are relatively new and in good condition. However, in established areas with aged plumbing systems, the pipes become misshapen and/or corroded with age. In areas with clay pipes, the pipes often become oval in shape with age and leaks due to cracking are widespread. The act of forcing the vortex device into fragile, corroded and/or misshapen pipes often causes the pipes to collapse or to be otherwise unacceptable for use. Also, conventional vortex devices are hand fabricated, resulting in significant dimensional deviations. Such deviations in many cases make it difficult to fit vortex devices into pipes.

In situations where the installation of a vortex device causes the pipes to collapse or become otherwise damaged, the area immediately surrounding the installation must be excavated so that a new pipe end may be installed which can accommodate the vortex device. As will be appreciated, this is a time consuming and expensive procedure.

Even when the conventional vortex devices are properly installed and under favorable conditions, the units are heavy due to their stainless steel construction, and difficult to manipulate in the often cramped working conditions of storm drains. Also, conventional vortex devices cannot be removed to clear trapped debris without removing the entire unit. This also requires heavy equipment and often leads to damage or destruction of the pipe in the immediate area.

Thus, there is a need for an improved vortex device which is more easily installed into a variety of operational applications and pipe conditions without damaging or destroying the pipe. There is also a need for such a device which can be removed from the pipe for cleaning or pipe repair without damaging or destroying the pipe.

Accordingly, a first object of the present invention is to provide an improved storm sewer overflow control device which is configured to sealingly fit in a variety of pipe diameters and conditions.

Another object of the present invention is to provide an improved storm sewer overflow control device which is installable without the use of heavy equipment.

Still another object of the present invention is to provide an improved storm sewer overflow control device which is easy to remove for the clearing of debris or for pipe repair purposes.

Yet another object of the present invention is to provide an improved storm sewer overflow control device which is lightweight and easily manipulable in storm drains.

A further object of the present invention is to provide an improved storm sewer overflow control device which adequately and/or selectively restricts the incoming flow of flood water to prevent the overloading of sewer mains.

SUMMARY OF THE INVENTION

The above-listed objects are met or exceeded by the present storm sewer overflow control device. A first advantage of the present device is that it can be installed in sewer pipes having a variety of dimensions, shapes and conditions. Also, the present device is easy to install or remove from sealing engagement with the pipe using simple hand tools, and in difficult working conditions, namely in the storm drain itself. The use of polymeric materials makes the present device resistant to corrosion, lightweight to handle, inexpensive to produce and affords the capability for mass production, thus resulting in uniform dimensions compared to conventional overflow control devices.

More specifically, a storm sewer overflow control device is provided for controlling runoff surge flows from a first pipe into a generally normally oriented second pipe. The device includes an engagement portion configured for insertion into the second pipe, a flow control portion attachable to the engagement portion and configured for receiving runoff surge flow flowing down the storm drain and slowing the flow for entry into the second pipe through said engagement portion. The engagement portion is radially expandable to sealingly engage an interior surface of the second pipe.

In the preferred embodiment, the engagement portion is configured to expand radially as it is shortened axially, specifically through the controlled movement of a wedge ring against radially expandable slats. It is also preferred to circumscribe the slats with at least one compressible sealing member such as an O-ring. An optional feature is a restrictor disk installable in the device to control the velocity of water flowing into the sewer main.

DETAILED DESCRIPTION OF THE PREFERRED EMBODIMENT

Figure 1:
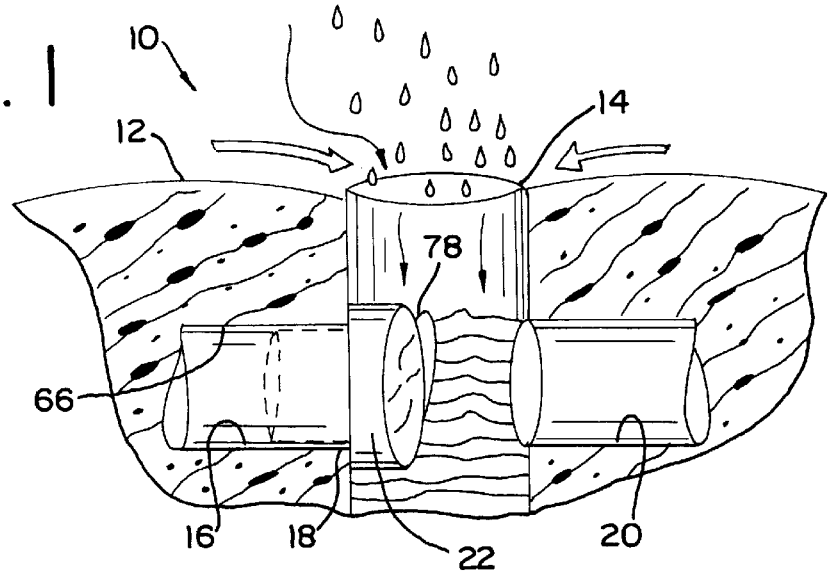
FIG. 1 is a schematic view of a storm water plumbing system, including a storm drain, several storm sewers, and the present storm sewer overflow control device.

Referring now to FIG. 1, a conventional storm water plumbing system is schematically depicted and generally designated 10. The system 10, typically placed underground adjacent a road 12, includes at least one generally vertically disposed storm drain 14 which is typically provided with an apertured manhole cover (not shown). At least one generally horizontally oriented storm sewer main 16 has an end 18 in fluid communication with the storm drain 14 as is known in the art. In some cases, residential or commercial storm sewer branch lines 20 may also be in fluid communication with the storm drain 14. The present storm sewer overflow control device, generally designated 22, is shown operationally disposed in the end 18 of the storm sewer main 16. It will be appreciated that the present device 22 is designed to be used wherever fluid velocity reduction is desired when fluid flows from a first pipe to a generally normally oriented second pipe.

Figure 2:
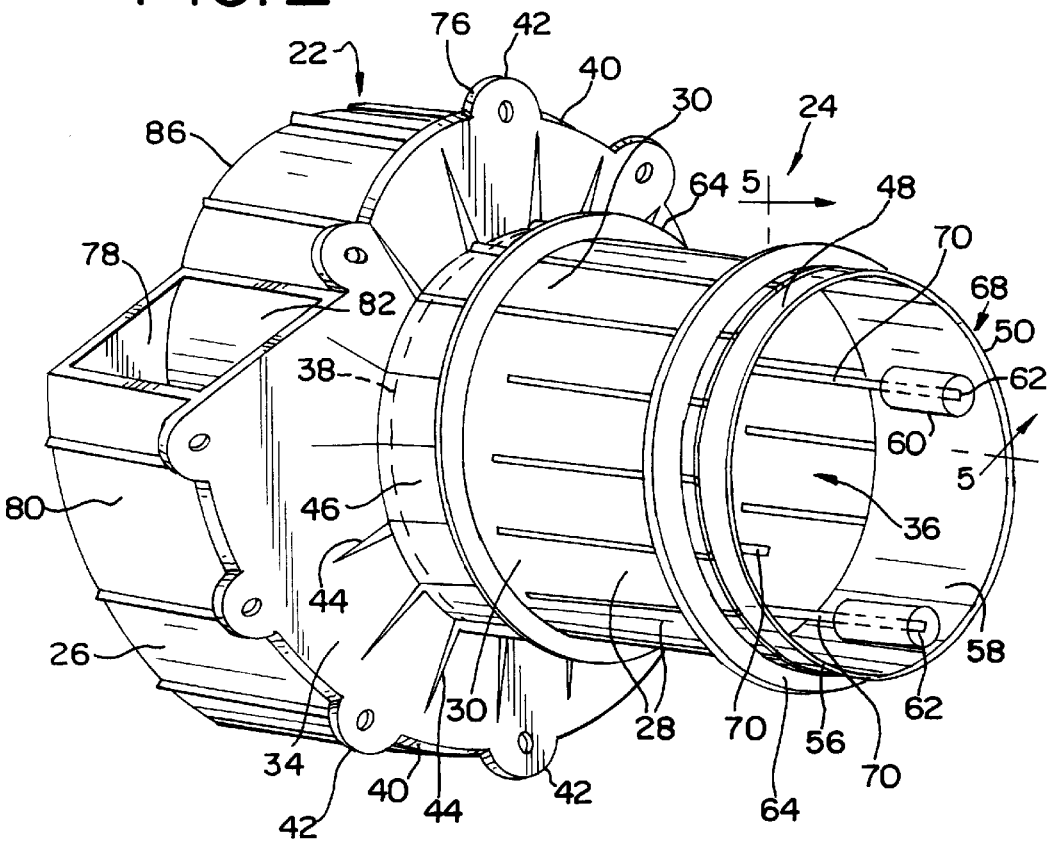
FIG. 2 is a rear perspective elevational view of the present storm sewer overflow control device.
Figure 3:
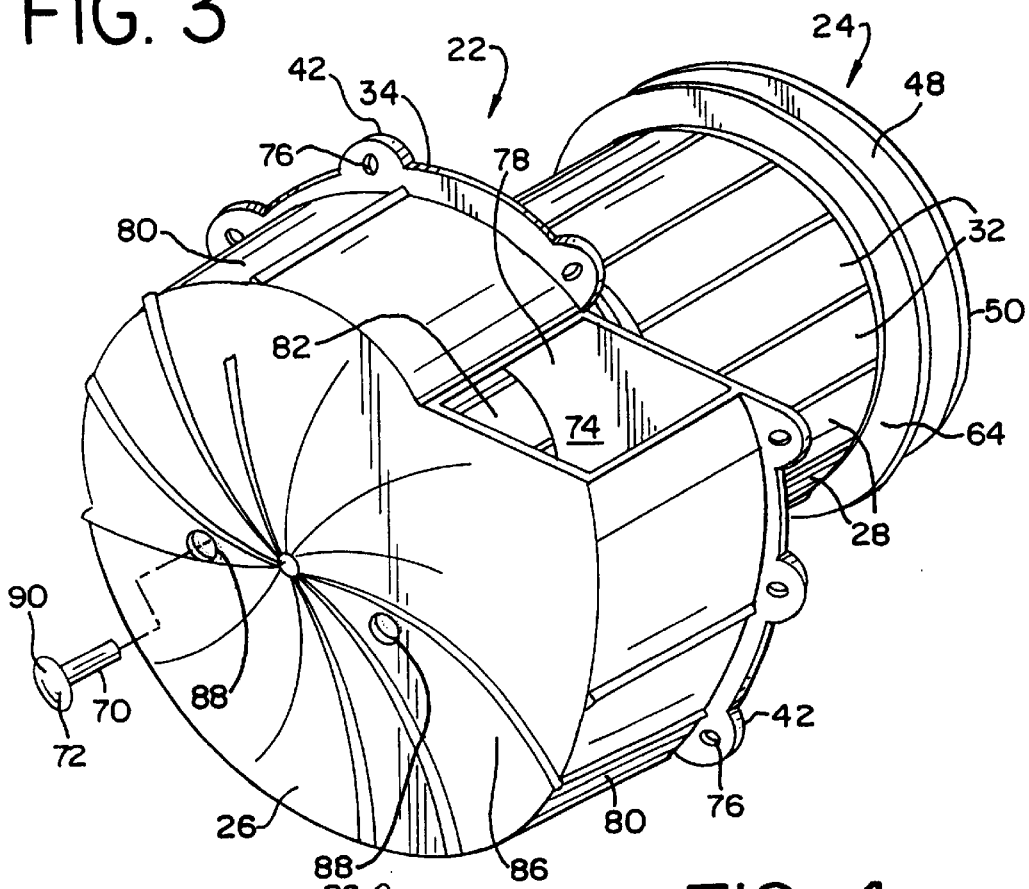
FIG. 3 is a front perspective elevational view of the device of FIG. 2.

Referring now to FIGS. 2 and 3, the storm sewer overflow control device 22 principally includes an engagement portion 24 configured for insertion into the pipe 16, and a flow control portion 26 which is attachable to the engagement portion 24 and is configured for receiving runoff surge flow flowing down the storm drain 14 and slowing the flow for entry into the storm sewer 16 through the engagement portion.

The engagement portion 24 includes a plurality of annularly spaced, generally parallel slats 28, each having a proximal end 30 closer to the flow control portion 26 and the storm drain 14, and a distal end 32 extending down into the sewer pipe 16. Each slat is virtually identical, and has a length and a thickness which can vary with the application, however a length in the range of 8 to 12 inches is preferred.

The proximal ends 30 are each joined to a radially extending flange 34 preferably at a 90° angle, and the preferably annular arrangement of the slats 28 defines a generally circular passageway 36. An opening 38 (shown hidden) in the flange 34 is in fluid communication with the passageway 36. In the preferred embodiment, the flange 34 and the slats 28 are integrally fabricated from a durable polymeric material known for its strength, environmental durability, chemical resistance, and water resistance. An example of such a material is acrylo-butadiene-styrene (ABS), however other known equivalent materials are also contemplated.

Figure 6:
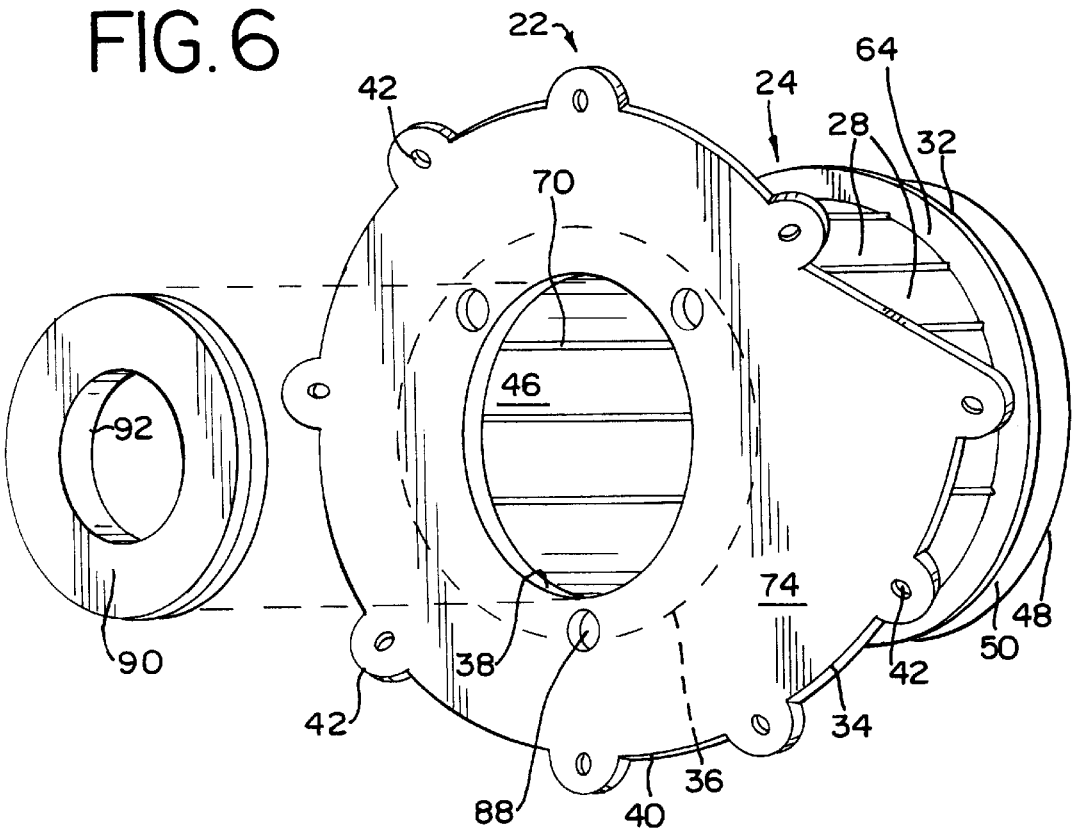
FIG. 6 is a front elevational view of the present device with the cowl removed.

A peripheral edge 40 of the flange 34 is provided with a plurality of eyelets 42. Also, in the preferred embodiment a plurality of support gussets 44 are provided at the junction of the proximal ends 30 and the flange 34 for added structural strength. In the preferred embodiment, the slats 28 are separated along their entire lengths, however it is contemplated that they may be joined together by a thickened band 46 (shown partially in FIGS. 2 and 6) for added structural support.

Figure 5:
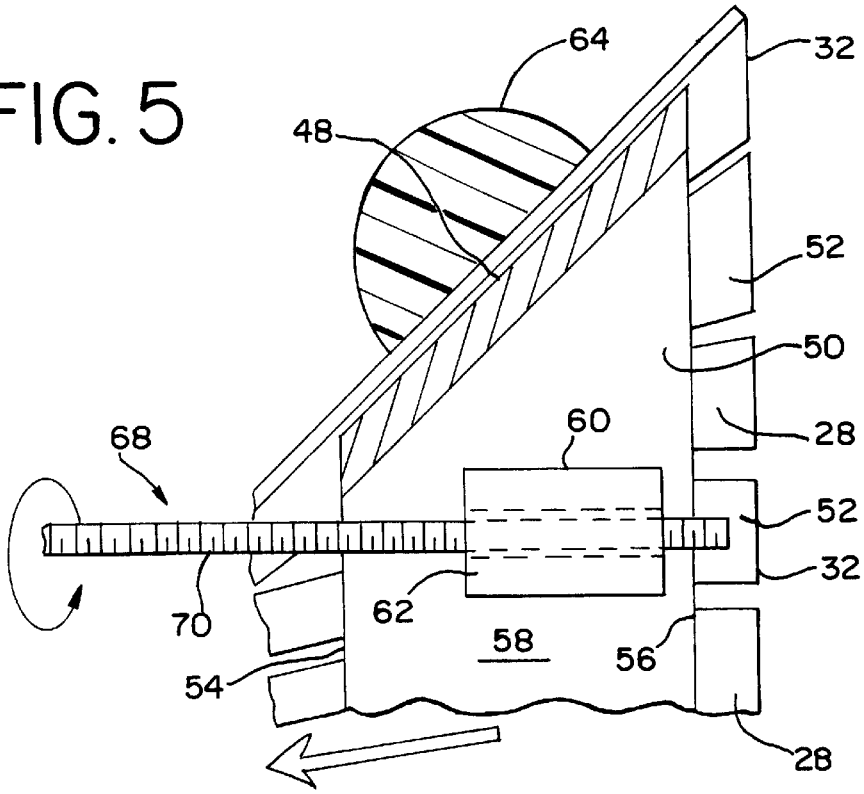
FIG. 5 is a sectional view taken along the line 5—5 of FIG. 2 and in the direction generally indicated.

Referring now to FIGS. 2, 3 and 5, opposite the proximal ends 30, the distal ends 32 are free, and engage an inclined or ramped surface 48 of a wedge ring 50, which is oriented to contact inside surfaces 52 of each of the slats 28. In size, the wedge ring 50 has a first outside diameter 54 which approximates the diameter of the passageway 36, and which is oriented toward the flange 34. A second, larger diameter 56 is at the outer edge of the inclined surface 48, and reflects the degree of incline. The second diameter 56 faces away from the flange 34.

An inside surface 58 of the wedge ring 50 has at least one and preferably three or four bosses 60 secured to the surface 58 and having threaded bores 62. In the preferred embodiment, the wedge ring 50 is made of the same or a similar material as the flange 34, and the bosses 62 are integrally molded with the ring.

At least one and preferably two annular seals 64 are provided to circumscribe the slats 28. In the illustrated preferred embodiment, the seals 64 are O-rings, and one ring 64 is disposed closer to the proximal end 30 or the flange 34, and the other is disposed closer to the distal end 32 or the wedge ring 50. It is preferred that the O-rings 64 are dimensioned so that upon placement about the slats 28, a tight gripping force is exerted by the rings against all of the slats, to the extent that the slats compress radially to a small extent as a result of this force.

An important feature of the present storm sewer overflow control device 22 is that it is configured to be sealingly secured within a wide variety of pipe diameters and of pipes of varying conditions. This feature is achieved by making the engagement portion 24 expandable to engage an interior surface 66 (best seen in FIG. 1) of the sewer pipe 16. More specifically, the engagement portion 24 is radially expandable to sealingly engage the interior pipe surface 66.

Referring now to FIGS. 2 and 5, in the preferred embodiment, this expansion is obtained through an expander mechanism, generally designated 68. Included in the expander mechanism 68 are the bosses 60 and a preferably corresponding number of threaded fasteners 70. The fasteners are at least as long as the slats 28 and are disposed on the insides thereof to be threadably engaged in the bores 62. Preferably stainless steel, polymeric or other corrosion resistant material, the fasteners 70 may be bolts, screws, Allen heads, Torx or other known fastener designs. Heads 72 (FIG. 3) of the fasteners 70 are rotationally disposed, yet axially fixed on the opposite side of the flange 34 from the slats 28.

Rotation of the fasteners 70 in the bores 62 will draw the wedge ring 50 toward the flange 34. In so doing, the distal ends 32 of the slats 28 will be engaged by the inclined surface 48 and expanded radially to expand to tightly engage the inside surface 66 of the pipe 16. In other words, as the engagement portion 24 shortens axially, it expands radially.

Referring now to FIGS. 2, 3, 4 and 6, turning now to the flow control portion 26 of the storm sewer overflow control device 22, the portion 26, also referred to as a cowl, is preferably configured to be fixed to the flange 34 on a side 74 opposite the slats 28. However, it is also contemplated that the cowl 26 may be releasably attachable to the flange 34. Accordingly, the cowl 26 has a like number of eyelets 76 which are dimensioned and configured to be in registry with the eyelets 42 on the flange 34. Upon orientation of the cowl 26 over the flange 34 so that the eyelets 42, 76 are in registry, preferably corrosion resistant fasteners (not shown) can be used to attach the two components. Any type of threaded or non-threaded fastener can be used to secure the eyelets together, as long as the cowl 26 is secured to the flange 34 in a watertight manner. If desired, opposing engaged edges of the flange 34 and the cowl 26 may be provided with a tongue-in-groove configuration or other type of gasket or seal relationship.

In configuration, the cowl 26 is designed to create a flow path for water attempting to enter the sewer pipe 16. An inlet 78 is disposed to receive water flowing down the storm drain 14, yet to restrict the volume of water which may enter the pipe 16. Further, the inlet 78 is oriented at an approximate 90° angle to the axis of the passageway 36 to reduce the velocity of the incoming water. In addition, a sidewall 80 of the cowl 26 has a portion 82 extending into the inlet 78 to act as a diverter vane.

Figure 4:
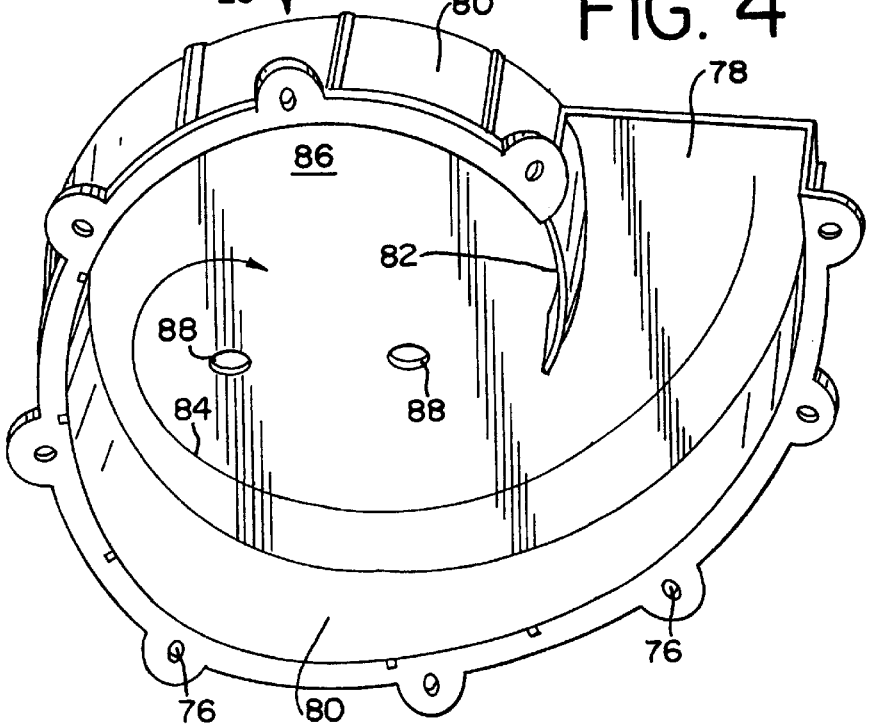
FIG. 4 is an elevational view of the inside of the cowl of the present device.

Referring now to FIG. 4, the diverter vane 82 and the generally circular shape of the sidewall 80 create a vortex-like flow path 84 which further reduces the velocity of the incoming water. A cover panel 86 further defines the flow path 84, which is in fluid communication with the passageway 36, and is preferably integrally formed with the sidewall 80. In the preferred embodiment, the cover panel 86 is provided with a number of fastener apertures 88 dimensioned and positioned to receive fastener heads located 72 at proximal ends of the fasteners 70. Thus, the heads 72 are accessible through the flow control portion 26.

To further control and reduce the velocity of water flowing into the passageway 36, the flange opening 38 may potentially have a smaller diameter than the passageway, to form a restriction in the flow path 84. It is contemplated that a supplemental restrictor disk 90 having an aperture 92 which is smaller in diameter than the opening 38 may be secured to the flange 34 to further restrict the flow velocity into the passageway 36. The restrictor disk 90 may be secured to the flange 34 using any known fastening technology, including threaded fasteners, chemical adhesives and/or ultrasonic welding. It is also contemplated that the disk 90 be configured as a replacement to the flange 34.

In operation, the present storm sewer overflow control device 22 may be installed assembled or in component form and assembled on site. If preassembled, the cowl 26 is secured to the flange 34. The engagement portion 24 is inserted into the pipe with the inlet 78 facing upward, until the flange 34 abuts the wall of the storm drain 14 (best seen in FIG. 1). Next, the installer places the appropriate driving tool, such as a nut driver or a screwdriver, preferably of the powered variety, into engagement with the head 72 of each of the fasteners 70. Preferably, the fastener heads 72 are accessed from outside the cover panel 86 as depicted in FIG. 3. As the fastener 70 is rotated clockwise, the wedge ring 50 will be drawn toward the flange 34. In this manner, the slats 28 are radially expanded to tightly engage the inside surface 66 of the pipe 16. The sealing relationship is facilitated by the O-rings 64, which are compressed against the exterior of the pipe 16.

If the device 22 is provided unassembled, the engagement portion 24 may be inserted into the pipe 16 as described above, and the cowl 26 fastened to the flange on site by inserting fasteners into the mating eyelets 42, 76. Expansion is achieved as described above in relation to the preassembled device. However, the fastener heads 72 may be accessed prior to attaching the cowl 26 by engaging the heads on the flange surface 74.

In the event that the device 22 becomes clogged with debris, or must be repaired, the operator has a choice of how much of the device to disassemble. If desired, only the cowl 26 need be removed by removing the fasteners from the eyelets 42, 76. Alternatively, the entire device 22 may be removed by unscrewing the fasteners 70. This operation radially retracts the slats 28 and the O-rings 64 so that the device 22 can be withdrawn from the pipe 16. An advantage of the present invention is that by using plastic components for the cowl 26 and the engagement portion 24, even if the fasteners 70 become corroded they can still be removed, unlike conventional stainless steel vortex units.

Thus, it will be seen that a lightweight, easy to assemble and disassemble storm sewer overflow control device has been provided. Many sizes and conditions of pipes can be accommodated, and a tight, sealing fit can be achieved without the use of heavy equipment. The relatively light weight of the present device 22 makes installation easy, even under the cramped conditions in a pipe. Existing pipes should not be damaged during installation of the present device 22, thus minimizing the time and expense of providing storm sewer overflow control, as opposed to conventional devices.

While a particular embodiment of the storm sewer overflow control device of the invention has been shown and described, it will be appreciated by those skilled in the art that changes and modifications may be made thereto without departing from the invention in its broader aspects and as set forth in the following claims.

What is claimed is:

1. A storm sewer overflow control device for controlling runoff surge flows from a first pipe into a generally normally oriented second pipe, comprising:

an engagement portion configured for insertion into the second pipe;

a flow control portion attachable to said engagement portion and configured for receiving runoff surge flow flowing down the storm drain and slowing the flow for entry into the second pipe through said engagement portion;

said engagement portion being radially expandable to sealingly engage an interior surface of the second pipe.

2. The device as defined in claim 1 wherein said engagement portion is configured to expand radially as it is shortened axially.

3. The device as defined in claim 2 wherein said engagement portion includes a plurality of spaced, generally parallel slats each having proximal and distal ends, said proximal ends being joined to a flange, said device further including a wedge ring, said distal ends engaging said wedge ring.

4. The device as defined in claim 3 further including an expander mechanism attached to said wedge ring, said wedge ring engages inner surfaces of said slats, said expander mechanism being configured for pulling said wedge ring toward said flange to push said slats radially against an inner surface of the second pipe.

5. The device as defined in claim 4 wherein said expander mechanism includes at least one threaded fastener with a distal end engaging said wedge ring, and a proximal end accessible near said flange so that rotation of said fastener causes said wedge ring to move toward said flange.

6. The device as defined in claim 5 wherein said proximal end of said fastener is accessible through said flow control portion.

7. The device as defined in claim 3 further including at least one annular seal configured to circumscribe said engagement portion.

8. The device as defined in claim 7 further including a pair of said seals, one located closer to said distal end, the other located closer to said proximal end.

9. The device as defined in claim 7, wherein said at least one seal is an O-ring.

10. The device as defined in claim 3 wherein said slats join said flange to define a fluid passageway.

11. The device as defined in claim 10 wherein said flange has an opening in fluid communication with said passageway, said opening having a smaller diameter than said passageway to form a restriction.

12. The device as defined in claim 11 further including a supplemental restrictor disk having a different diameter from said opening in said flange for changing the amount of restriction.

13. The device as defined in claim 1 wherein said flow control portion is a cowl defining an inlet, having at least one diverter vane, said engagement portion defining a fluid conduit, said inlet being in fluid communication with said fluid passageway.

14. The device as defined in claim 13 wherein said engagement portion includes a flange, said cowl is releasably attachable to said flange.

15. The device as defined in claim 1 wherein said cowl is configured to restrict the amount of fluid entering said engagement portion.

16. A storm sewer overflow control device for controlling runoff surge flows from a generally vertically oriented storm drain into a generally horizontally oriented storm sewer pipe, comprising:

an engagement portion configured for insertion into the storm sewer pipe and including a flange, a wedge ring, a plurality of annularly spaced slats each having a proximal end secured to said flange and a distal end engaging said wedge ring;

a flow control portion attachable to said flange and defining a flow path configured for receiving runoff surge flow flowing down the storm drain and slowing the flow for entry into the storm sewer pipe; and expander mechanism configured to draw said wedge ring toward said flange to radially expand said slats against an inside surface of the storm sewer pipe.

17. The device as defined in claim 16 wherein said flow control portion is a cowl defining a fluid flow path upon attachment to said flange.

18. The device as defined in claim 16 further including at least one annular seal configured to circumscribe said slats.

19. The device as defined in claim 18 further including a pair of said seals, one located closer to said distal end, the other located closer to said proximal end.

20. The device as defined in claim 14 wherein said expander mechanism is accessible from said flow control portion upon attachment of said flow control portion to said flange.

* * * * *